United States Patent [19]

Rishworth et al.

[11] Patent Number: 4,795,374

[45] Date of Patent: Jan. 3, 1989

[54] DOUBLE SIDED EDGE CONNECTOR

[75] Inventors: Paul L. Rishworth, Chicago; Alan S. Walse, LaGrange, both of Ill.

[73] Assignee: Molex Incorporated, Lisle, Ill.

[21] Appl. No.: 218,418

[22] Filed: Jul. 12, 1988

Related U.S. Application Data

[63] Continuation of Ser. No. 46,375, May 4, 1987, abandoned.

[51] Int. Cl.[4] ..... H01R 9/09

[52] U.S. Cl. ..... 439/634

[58] Field of Search ..... 439/629–637

[56] References Cited

U.S. PATENT DOCUMENTS 3,868,166 2/1975 Ammon ..... 439/634

4,026,014 5/1977 Sugimoto et al. ..... 439/634

*Primary Examiner*—Joseph H. McGlynn

*Attorney, Agent, or Firm*—John W. Cornell; Louis A. Hecht

[57] ABSTRACT

A double sided edge connector is provided including a housing formed from a pair of substantially identical hermaphroditic housing halves and aligned pairs of electrical terminals. Each housing half includes a plurality of parallel spaced apart contact guides defining contact receptacles therebetween. Each housing half further includes a longitudinally extending contact retaining wall adjacent the top of the housing half and defining a portion of each contact receptacle. Each terminal includes a central mounting portion, a solder tail at one end and a contact beam at the other end. The contact beam is of a double bent configuration to provide anti-overstress protection to the terminals in use. The terminals are heat staked into the respective receptacles such that the end of the each contact beam is biased against the contact retaining wall. The substantially identical housing halves with the terminals heat staked therein are hermaphroditically mated and are heat staked together.

6 Claims, 3 Drawing Sheets

DOUBLE SIDED EDGE CONNECTOR

This application is a continuation of application Ser. No. 046,375 filed May, 4, 1987, now abandoned.

BACKGROUND OF THE INVENTION

The present invention relates to a new and improved high density, low pitch miniaturized edge card connector. More particularly, it relates to an edge card connector including a two-part housing assembled from hermaphroditic or complementary halves characterized by improved control over manufacturing tolerances and a plurality of substantially stress resistant metallic terminals positively positioned and mounted in the housing providing improved pitch control in mating and electrical reliability in use.

Edge connectors include a nonconductive housing having an elongated slot dimensioned to receive an edge of a circuit card or the like. The edge connector includes a plurality of electrical contacts disposed to be aligned with the conductive leads on the circuit card. To ensure good electrical connection, the various contacts must be urged against the conductive leads of the circuit card upon the insertion of the circuit card into the connector.

The edge connector typically is mounted to a printed circuit board on which an array of conductive strips is printed or otherwise disposed. A portion of each contact in the edge connector is electrically connected to the conductive strips on the printed circuit board. For example, each contact of the edge connector may include a solder tail which extends through an aperture in the printed circuit board. The solder tails then may be connected electrically to the conductive strips on the printed circuit board to which the edge connector is mounted.

The housing of the typical prior art edge connector is molded as a unitary member to include both the slot for the circuit card and a plurality of elongated receptacles for receiving at least portions of each electrical contact. The contact receptacles may extend into the connector from the side opposite the slot. In this type of prior art edge connector, the electrical contacts are inserted into the connector housing in one direction, while the circuit card is inserted in an opposite direction. In other embodiments of the prior art edge connector, the various electrical contacts are inserted into the housing in generally the same direction as the card.

In recent years, there has been a remarkable trend toward miniaturization of electrical components. This trend has required the electronics industry to produce both smaller electrical contacts and smaller housings. For example, many specifications require edge connectors with a plurality of contacts disposed at 0.050 inch center to center spacings. Many of these very small edge connectors are used for double sided circuit cards. Thus, within a very small space (e.g. 0.050 center to center spacing) it is necessary to provide two contacts. It is also necessary to ensure that both the housing and each of the contacts is precisely mounted to achieve the required contact pressure against the conductive strips on the circuit card.

The miniaturization of electrical components has contributed to substantial problems in manufacturing edge connectors. In particular, the prior art edge connector of unitary construction has been injection molded in an apparatus having core pins to define the respective receptacles for the individual contacts. However, the small contacts disposed at very small center to center spacings require core pins with a very long length for their cross-sectional area. As a result, the core pins are easily damaged or deformed during high pressure injection molding processes. The damaged core pins produce defective connectors. Additionally, it is difficult to insert the very small electrical contacts in a longitudinal direction into the edge connector. Even small misalignments between the contacts and the connector housings can substantially damage the contacts during insertion into the housing. Furthermore, the possibility of imprecision in either the housing or the contacts could result in an unacceptable electrical connection with a circuit card or the like.

One prior art edge connector that has attempted to deal with certain problems resulting from miniaturization is shown in U.S. Pat. No. 4,479,686 which issued to Hoshino et al on Oct. 30, 1984. The connector of U.S. Pat. No. 4,479,686 was specifically directed to the problem of placing a large number of closely spaced apertures through a printed circuit board to receive the solder tails of the connector. In particular, the connector of U.S. Pat. No. 4,479,686, addresses the problem of closely spaced apertures in a printed circuit board by providing a single large rectangular aperture into which a portion of the base of an edge connector is seated. The edge connector shown in U.S. Pat. No. 4,479,686 includes two opposed injection molded halves which are secured to one another. The electrical contacts of the connector shown in U.S. Pat. No. 4,479,686 are mounted in the injection mold, and the connector half is molded around the respective contacts. Each contact is of generally U-shape with one leg of the U being bowed along a portion of its length. The bowed contact leg is disposed to lie within the card receiving slot of the connector. A portion of the straight leg of each U-shaped contact is imbedded in the injection molded plastic of the housing. However, a second part of the straight contact leg lies exposed adjacent the base of the connector housing. The conductive strips on the printed circuit board are disposed to abut against the exposed portion of each contact and are soldered thereto. The connector of the U.S. Pat. No. 4,479,686 requires an extremely complex molding process wherein each contact must be precisely positioned within the mold and held in that position during the high pressure injection molding process. Additionally, the contact is not optimumly configured to achieve the desired pressure on a circuit card disposed in the connector.

In view of the above, it is an object of the subject invention to provide an edge connector that is particularly well suited for closely spaced electrical contact and terminal arrays.

Another object of the subject invention is to provide an edge connector that facilitates the placement of the electrical terminals in the connector housing.

A further object of the subject invention is to provide an edge connector that provides a secure positively positioned mounting of the electrical terminals therein.

Still a further object of the subject invention is to provide an edge connector that provides improved centerline to centerline mating between edge card contact pads and the contact portions of the terminals in an edge card socket.

SUMMARY OF THE INVENTION

The subject invention is directed to a double sided edge connector which comprises a connector housing and a plurality of aligned pairs of opposed electrically conductive terminals securely mounted therein. The connector housing includes an elongated slot defining an edge card socket adapted to receive the mating edge of a circuit card or the like. The aligned pairs of terminals are disposed along the slot, with adjacent pairs of terminals being closely spaced to one another. In the typical embodiment, as explained below, the centerline to centerline spacing between adjacent pairs of contacts may be approximately 0.050 inch or less. The opposed contact portions in each aligned terminal pair may be slightly spaced from one another to permit the mating edge of the circuit card to be inserted therebetween, and to enable each terminal to make electrical connection with the contact pads or other conductive leads printed or otherwise disposed along the mating edge of the circuit card.

The connector housing preferably is formed from a pair of hermaphroditic longitudinally extending housing halves. The housing halves may be substantially identical, thereby yielding low molding and manufacturing costs and avoiding inventory problems. However, in certain embodiments, it may be desirable to provide the housing with polarization means to ensure that the circuit cards are properly inserted. The polarization means may mandate the use of slightly dissimilar housing halves, but would still permit the other advantages described herein. The housing halves each may be provided with means for assuring proper alignment of the housing halves to one another, and means to facilitate the heat staking or ultrasonic welding of the housing halves to one another.

Each housing half may include spaced apart opposed end walls, and opposed top and bottom walls connected to and extending between the end walls. An outer side wall may extend between and connect the end walls and the top and bottom walls. As a result of this construction, the inner face of each connector half will be at least partly open and may be disposed in generally opposed face to face relationship with the inner face of another housing half on the assembled connector housing. Each connector half may further be characterized by a plurality of generally parallel spaced apart contact guides which extend generally orthogonal to the top, bottom and outer side wall of each connector housing half. The spacing between adjacent guides is substantially equal to the width of the terminals employed with the housing, such that the space between adjacent guides defines a contact receptacle for one terminal in each pair of terminals. Thus the terminals may be aligned in the receptacles and generally parallel to the contact guides formed in the connector housing to control the side-to-side spacing between the centerlines of adjacent terminals. Each guide may further be provided with positioning means for assuring the proper location of each terminal contact portion relative to the top and bottom walls of the connector housing. The positioning means may define ribs or notches in the guides which mate with corresponding structures on each contact.

Each contact receptacle may further be defined by a contact retaining wall which also defines a portion of the slot in the housing and which accurately positively positions the contact portions of each terminal relative to the slot. The contact retaining walls may extend continuously between the end walls of the housing half and may be parallel to the outer side wall and connected to the top wall.

The depth of the contact receptacles measured perpendicular to the outer side wall is shallow relative to the length of each contact guide. As a result, the contact receptacles and the adjacent contact guides can be easily molded without the long slender core pins that were described with respect to prior art connector housings of unitary construction. These shorter core pins are not likely to be damaged or bent during injection molding, thereby achieving more accurately dimensioned receptacles for receiving the terminals of the connector. The connector halves of this invention may be consistently molded on conventional molding equipment within extremely close tolerances. This in turn provides better terminal placement or location within the terminal retaining structures of the housing half to provide improved pitch control for the terminals and improved centerline to centerline mating between the terminals of the connector and the contacts on the card.

The terminals of the subject connector are elongated electrically conductive members having a solder tail at one end, a generally centrally disposed mounting portion and a bifurcated contact beam portion at the opposed end. The generally centrally disposed mounting portion is configured to closely fit between the contact guides of the connector housing half adjacent the bottom wall and to engage the positioning means thereof to ensure proper positioning of the terminals between the top and bottom walls of the housing half. Each terminal is die formed to include a specially configured anti-overstress contact beam having a tailored stress-strain profile to provide improved contact and deflection performance for the terminals and to further provide improved reliability for the edge connector in use. Preferably, the opposed contact beam portions of each aligned pair of terminals first undergo a slight bend away from one another in proximity to the mounting portion thereof. The contact portions then preferably undergo a bend toward one another and toward the slot of the housing. The contact portions then undergo still another bend away from one another such that each pair of opposed contact portions defines a pair of facing convex contact surfaces disposed in the slot of the housing. The extreme end of each terminal contact beam portion may further be bent to enable the contact beam portion to positively engage the contact retaining wall of the respective connector housing half, thereby preloading the contact beam portions and accurately controlling the position of the contact portions toward one another. The bifurcated construction of the contact beam portion insures a quality electrical connection.

The terminals are mounted in the respective contact receptacles of the connector housing half with the contact beam portions preloaded against the contact retaining wall. Once in position, a portion of each contact guide is heat staked over the terminal mounting portions to positively secure the terminals in the respective receptacles to render the solder tails more rigid and to carefully assure accurate placement of both ends of each terminal. The respective connector housing halves then are hermaphroditically assembled and are welded or heat staked into their assembled condition.

DETAILED DESCRIPTION OF THE PREFERRED EMBODIMENT

Figure 1:
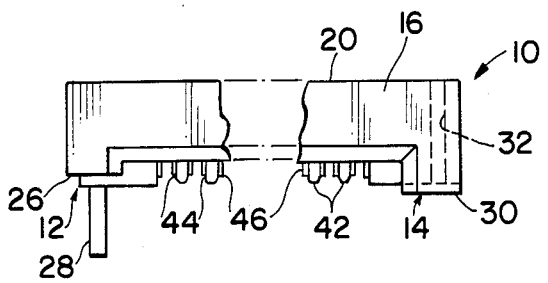
FIG. 1 is a top plan view of a connector housing half in accordance with the subject invention.
Figure 2:
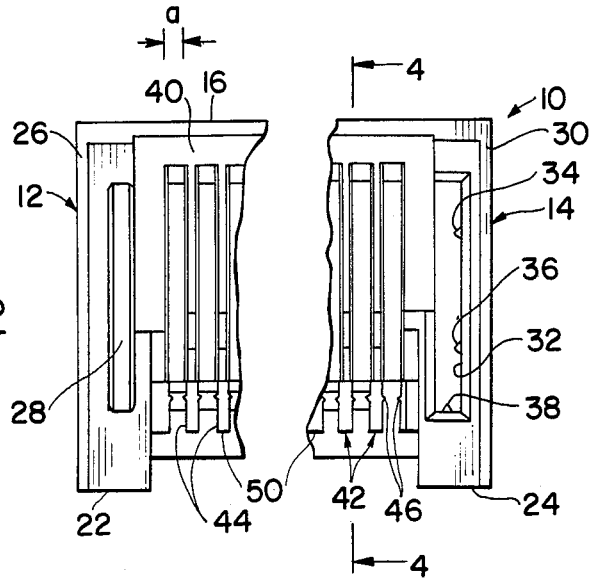
FIG. 2 is a front elevational view of the connector housing half shown in FIG. 1.
Figure 3:
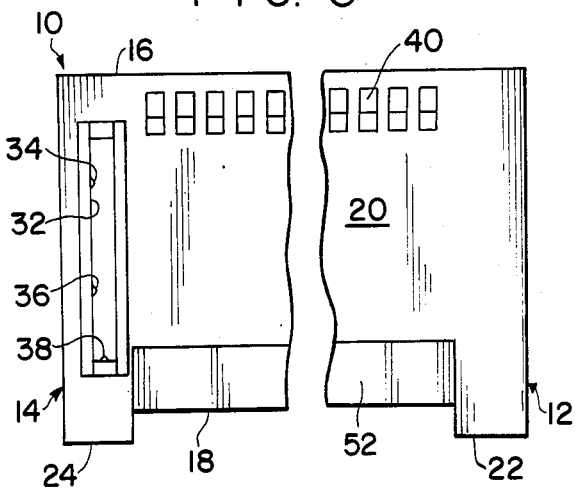
FIG. 3 is a rear elevational view of the connector housing half shown in FIGS. 1 and 2.
Figure 4:
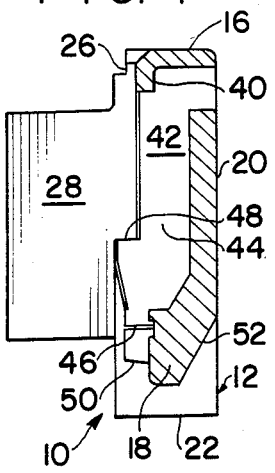
FIG. 4 is a cross sectional view taken along line 4—4 of FIG. 2.

The connector of the subject invention comprises a housing formed from a pair of hermaphroditic connector housing halves. The connector housing half of the subject invention is indicated generally by the numeral 10 in FIGS. 1-4, and is a unitary injection molded structure. The housing half 10 is generally of rectangular open-sided configuration, and includes opposed first and second end walls 12 and 14, opposed top and bottom walls 16 and 18, and outer side wall 20. The first and second end walls 12 and 14 extend beyond the bottom wall 18 to define first and second bases 22 and 24. Thus if the first and second bases 22 and 24 of the first and second end walls 12 and 14 are supported on a surface, the bottom wall 18 will be spaced from the surface. The first and second end walls 12 and 14 also extend beyond the top wall 16 as shown in FIG. 1 to enable a slot or edge card socket to be formed when two housing halves 10 are assembled as explained below.

The first end wall 12 of housing half 10 is characterized by a peripheral undercut portion 26 and by a generally rectangular post 28. The second end wall 14 is characterized by a peripheral rib 30 which is disposed and dimensioned to engage the peripheral undercut 26 on a similar or identical connector housing half 10. The second end wall 14 further comprises a generally rectangular aperture 32 extending entirely through the housing half 10. The aperture 32 is dimensioned to receive a post 28 from a second housing half 10. The rectangular aperture 32 is further characterized by ribs 34, 36 and 38 which extend into the aperture, and require a slight force fitting of the rectangular post 28 of a second housing half 10.

The housing half 10 is further characterized by a contact retaining wall 40 extending substantially the entire longitudinal distance between the end walls 12 and 14 and disposed substantially adjacent the top wall 16 of the housing half 10. The contact retaining wall 40 is spaced from and parallel to the outer side wall 20 of the housing half 10.

The housing half 10 includes an array of parallel contact guides 42 extending orthogonally from the top and bottom walls 16 and 18, the outer side wall 20 and the contact retaining wall 40. The contact guides 42 are spaced from one another to define contact receptacles 44 therebetween. More particularly, the contact guides 42 are spaced from one another by a distance "a" substantially equal to the width of a terminal described in greater detail below. Each guide 42 is characterized by alignment ribs 46 which extend into the respective contact receptacles 44. As explained further below, the alignment ribs 46 insure proper alignment of each contact portion of each terminal with respect to the top wall 16 and bottom wall 18 of the housing half 10. Additionally, the alignment ribs 46 are dimensioned to securely but temporarily retain the respective terminals in the contact receptacles 44.

The contact guides 42 further include a ledge 48 at a selected distance from the top wall 16. More particularly, as shown most clearly in FIG. 4, the ledge 48 extends from a location substantially in line with the contact retaining wall 40 for a distance substantially equal to one-half the specified thickness of the circuit card to be employed with the connector of the subject invention. The ledge 48 will define the maximum insertion depth of the circuit card, as explained further below.

The contact guides 42 each include a bottom edge 50 which will cooperate with the terminals to ensure proper alignment of the terminals in the housing half 10.

The housing half 10 further includes a chamfer 52 between the bottom wall 18 and the outer side wall 20. The chamfer 52 and the elevated position of bottom wall 18 relative to bases 22 and 24 achieve several objectives. First, the chamfer 52 enables the plastic of the housing half 10 to be of substantial uniform thickness through the rear wall 20 and the bottom wall 18. This uniform thickness of the plastic material results in various injection molding efficiencies. Additionally, the chamfer 52 substantially increases the visibility of locations at which electrical connections will be made. This is a particularly desirable feature for surface mount versions of the connector where solder connections will be made on the top surface of a circuit board and in proximity to the bottom wall 18.

Figure 5:
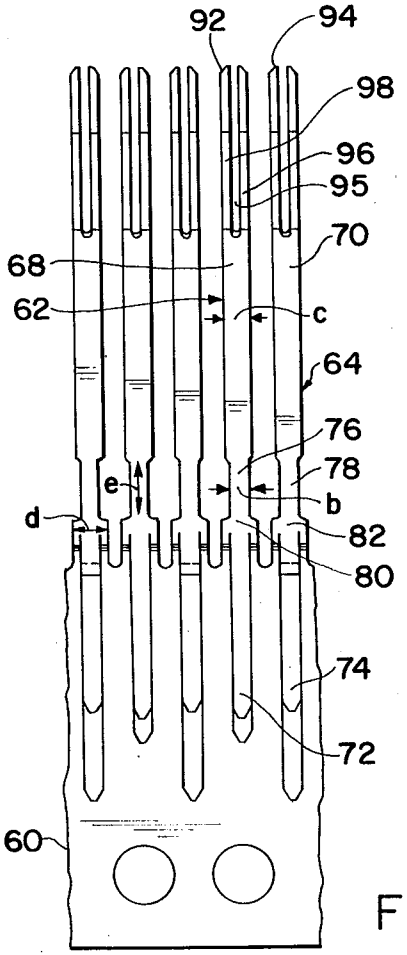
FIG. 5 is a top plan view of a plurality of electrical contacts in accordance with the subject invention.

The formed terminals of the subject invention are identified generally by the numerals 62 and 64 in FIG. 5. The terminals 62 and 64 are stamped from a strip of metal and are die formed. Advantageously, these forming operations are performed with the terminals being initially temporarily connected to a carrier strip 60. The terminals 62 and 64 each are elongated structures having bifurcated contact beam portions 68 and 70 respectively at one end and solder tails 72 and 74 at the opposed end thereof. The principal difference between the formed terminals 62 and 64 is the length of the respective solder tails 72 and 74. More particularly, the solder tail 74 of terminal 64 is longer than the solder tail 72 of the terminal 62. This difference in length between the solder tail 72 and 74 reflects the fact that the solder tail 74 will be bent through two substantially 90° turns to provide a staggered array of solder tails, as shown in FIGS. 7 and 8, adapted for electrical connection, for example, to a corresponding staggered footprint array of throughhole apertures on a base printed circuit board or motherboard.

The terminals 62 and 64 are provided respectively with mounting portions 76 and 78 which are substantially identical to one another and which define a width "b" which is narrower than the width "c" of the bifurcated contact beam portions 68 and 70. Additionally, the width "b" of the mounting portion 76 of terminal 62 is substantially equal to the distance between the alignment ribs 46 in each contact receptacle 44 of the housing half 10.

The terminals 62 and 64 further include alignment shoulders 80 and 82 respectively which define a width "d" which is greater than the width "c" of the bifurcated contact beam portions 68, 70 and which is greater than the distance "a" between adjacent guides 42 of the housing half 10. Furthermore, the length "e" of the mounting portions 76, 78 is substantially equal to the distance between the alignment ribs 46 and the bottom 50 of each contact guide 46. Thus, as will be explained further below, the mounting portions 76 and 78 insure that the respective terminals 62, 64 are longitudinally fixed in their respective contact receptacles 44 of the housing half 10.

Figure 6:
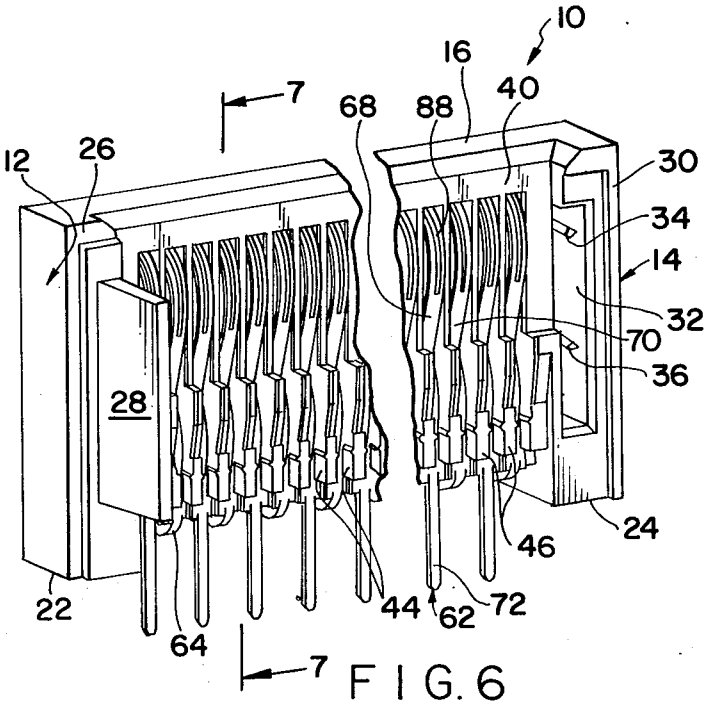
FIG. 6 is a perspective view of the connector housing half of the subject invention with a plurality of electrical contacts mounted therein.
Figure 7:
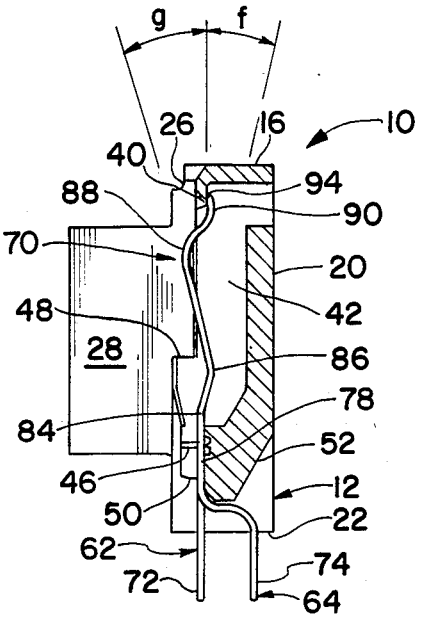
FIG. 7 is a cross-sectional view along line 7—7 of FIG. 6.
Figure 8:
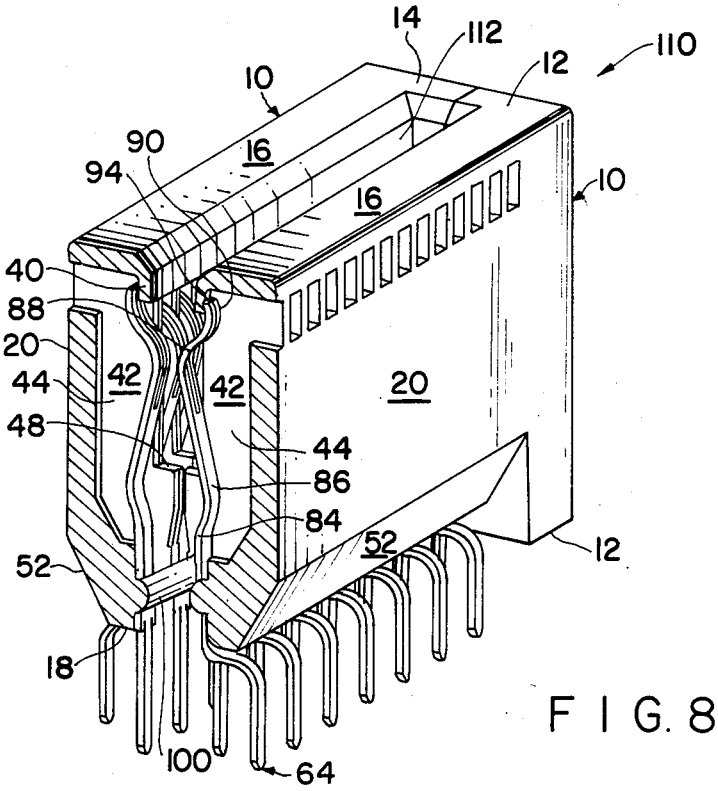
FIG. 8 is a cross-sectional view of a fully assembled connector in accordance with the subject invention.

The final stamped and formed configuration of each terminal 62, 64 and the mounting within the housing half 10 is shown in FIGS. 6–8. More particularly, the mounting portions 76, 78 and the alignment shoulders 80, 82 lie substantially in a common plane on the respective terminals 62 and 64. The contact beam portion 68 of the terminal 62 is substantially identical to the contact beam portion 70 of the terminal 64. The contact beam portions 68 and 70 include a reverse or outward bend 84 toward the outer side wall 20 of housing half 10. The outward bend defines an angle "f" of approximately 20°–30° with respect to the planar alignment of the mounting portion 78.

The contact beam portions 68 and 70 then undergo an inward bend 86 away from the outer side wall 20 to assume an inward angle "g" of approximately 20°–30° with respect to the planar alignment of the mounting portion 78. The outward bend 84 and the inward bend 86 both are defined by radii of approximately 0.09 inch. The contact beam portion 68 extends tangentially from the inward bend 86 to an outwardly extending contact bend 88 which defines a radius of approximately 0.05 inch and which extends through a curve of approximately 75°. The contact bend 88 will define a convex contact surface with the slot of the connector.

The end of the contact beam 70 is defined by an inwardly directed contact retaining curve 90 which cooperates with contact retaining wall 40 to preload the contact beam portions 68 and 70 of terminals 62 and 64 in the housings.

Terminals 62 and 64 are die-formed to provide specially configured contacting portions 68 and 70 for enhanced reliability of connector 10 in use. More particularly, the die-forming operation is effective to provide a relatively permanent deformation to the metallic terminal. This forming process results in a new permanent set in the metal in which the terminals are made which in fact changes stress strain response profiles of the contact beam portion of the mounted terminal.

In greater detail, a major concern in designing edge card connectors, particularly those which are intended for prolonged use, is that the contact portions of the terminals mounted therein must make good high pressure electrical contact with the conductive regions of an edge card. Reliable electrical contact for one or all of the circuits may be lost if the contact portions of the terminals are damaged by overstressing, for example, during edge card insertion or after repeated edge card insertion. The terminals may be overstressed, for example, by overdeflecting the beam portion of some or all of the terminals by inserting an edge card in an improper angle or by dimensional tolerances in the thickness of the edge card. For whatever reason, if the contact beam portion is over deflected beyond the yield point of the mounted metal erminal, a new bend or permanent set is imparted to the terminal. Subsequently, upon removal of the edge card, the overstressed terminal will not fully resiliently return to its initial pre-insertion position. Terminal overstressing results in contact mating misalignment and a generally reduced contact pressure between the terminal and the edge card resulting in a low quality, low reliability electrical connection.

The configuration of terminals 62 and 64 of the present invention are specifically designed to provide an anti-overstress bend at 84 to substantially reduce the possibility of overstressing the terminals in use. More particularly, referring now to FIGS. 7 and 8, terminal 64 is provided with a reverse or outward bend 84 immediately adjacent mounting portion 78. Reverse bend 84 has imparted a permanent set in the metal in a right-hand direction as shown in FIG. 7, which is in the same direction as deflection of the contact beam 70 upon insertion of an edge card into the card slot 112. Bend 84 effectively changes the stress-strain profile of terminal 64 at bend 84, such that bend 88 can be deflected in a rightward direction shown in FIG. 7, e.g. by insertion of an edge card, a greater deflection before a yield point in the metal at bend 84 is reached, than would be provided with a terminal which did not include an outward bend 84. The result of providing this configuration is that for the full range of contemplated deflection possibly encountered during mating of an inserted edge card, the terminals including outward bend 84 generally cannot be overstressed in use. The material set of metal terminal generally will not reach a yield point during repeated insertion of an edge card. In accordance with this aspect of the invention, substantially the full calculated resilient contact pressures for terminal 64 are maintained, and upon removal of an edge card, contact beam portion 70 of terminal 64 including bend 84 will generally resiliently completely return to its original undeflected position as shown in FIG. 7, even after repeated edge card insertion.

The contact beams 68, 70 are bifurcated from the extreme ends 92, 94 to locations beyond the respective contact bends thereof. The bifurcation is defined by a longitudinally extending slit 95 having a width approximately equal to one-third the width "c" of the contact beam 68. Thus, for a contact beam 68 having a width "c" equal to 0.027 inch, the slit 95 will have a width of approximately 0.009 inch. The slit 95 effectively defines two independent contact portions 96 and 98 which enhance the reliability of the terminal 62. In particular, a small speck of non-conductive material that might conceivably be disposed on the circuit card used with the connector will only affect the electrical connection of one of the two contact portions 96 or 98, thereby leaving the other contact portion 96 or 98 to make a secure electrical connection with the conductive material on the circuit card.

The terminals 62 and 64 are mounted alternately in the contact receptacles 44 of the housing half 10, as shown most clearly in FIGS. 6 and 7. More particularly, the extreme end 94 of the contact beam 70 is inserted between the contact retaining wall 40 and the outer side wall 20 of the contact receptacle 44. The mounting portion 78 of terminal 64 is then urged into position between the contact guides 42 which define the respective contact receptacles 44. As the mounting portions 78 are urged into the appropriate contact receptacle 44, the alignment shoulders 82 will engage the bottom 50 of each contact guide 42 of the appropriate receptacle 44. This engagement of the alignment shoulder 82 with bottom 50 of the contact guides 42 positively prevents a movement of the terminal 64 toward the top wall 16 of the housing half 10. Similarly, the alignment ribs 46 extending into each contact receptacle 44 will engage the portion of contact beam 70 adjacent the mounting portion 78 to prevent a movement of the terminal 64 away from the top wall 16. Thus, the contact guides 42 of the housing half 10 prevent lateral movement of the terminal 64, while the cooperation between the alignment shoulder 82 and the guide bottom 50 and the cooperation between the contact beam 70 and the alignment ribs 46 positively prevent longitudinal movement of each terminal 64. As noted above, the terminals 62 and 64 are identical but for the lengths of the respective solder tails 72 and 74. Thus the terminals 62 can be positively positioned in the contact receptacles 44 as explained above with respect to terminals 64.

The anti-overstress configuration of the terminal 64, as shown most clearly in FIG. 7, utilizes residual stresses created during the forming operation to give better deflection and spring characteristics and to achieve desired normal contact forces at the point of electrical contact. In the fully mounted position as shown in FIG. 7, the contact beam 70 will have a preload in an inward direction. The contact beam 70 and the contact retaining wall 40 of the housing half 10 cooperate with one another in a plurality of different ways. First, the contact retaining wall 40 stops the inward movement of the contact beam 70 that would otherwise be caused by the geometry imparted by the double bent configuration. Second, the contact retaining wall 40 positively and accurately defines the maximum inward position of the contact beam 68 and in particular accurately defines the position of the convex surface defined by the contact bend 88. Third, the contact retaining wall 40 prevents any inadvertent potentially damaging contact with the fragile ends 92, 94 of the contact beam 68 and 70.

The various terminals 62, 64 are heat staked into position to provide positive retention in the housing half and to fix the solder tails 72, 74 rigidly relative to the bottom wall 18 of the housing half 10 and relative to the circuit board on which the housing may be mounted. More particularly, the heat staking is achieved by application of heat means or ultrasonic means. The heat staking takes place approximately in the position of the mounting portion 76, 78 of the terminals 62, 64 which corresponds to the portion approximately between the alignment ribs 46 and the bottom 50 of each contact guide 42. The heat staking will effectively define a continuous unitary bead 100 extending along the bottom wall 18 as shown in Figure 8.

The assembled connector is shown in FIG. 8 and is identified generally by the numeral 110. The connector 110 is formed from substantially identical housing halves 10, each of which has a plurality of terminals 62 and 64 heat staked therein. The housing halves 10 are assembled such that the rectangular posts 28 of one housing half 10 is received in the rectangular aperture 32 of the other housing half 10. The respective housing halves 10 are heat staked, sonically welded or otherwise securely retained in their mated condition.

In the assembled condition of the connector 110, the terminals 62 and 64 have an inwardly directed preload created by mounting the ends 92, 94 of each terminal 62, 64 against the contact retaining wall 40. When a circuit card, or the like, is inserted into the slot or socket 112 defined in the connector 110, the circuit card will contact and deflect the respective contact beams 68, 70 of each terminal 62, 64. Continued movement of the circuit card of the like into the slot 112 will urge the contact beams 68, 70 outwardly within the respective contact receptacles. Further downward movement will cause complete seating of the circuit card in the slot 112 and adjacent the ledges 48 defined on contact guides 42. In this fully seated condition, the contact beam portions 68, 70 will be urged against the circuit card by virtue of their geometry and spring characteristics. Additionally, the bifurcated configuration of each contact beam 68, 70 will insure electrical contact with the circuit card even if a small non-conductive particle may be disposed upon a portion of the circuit card or contact.

In summary, a double sided edge connector is provided which includes a housing formed from substantially identical housing halves which are hermaphroditically mated to one another. Each housing half defines an elongated structure having opposed end walls, opposed top and bottom walls, an outer side wall and a contact retainer wall. The end walls are constructed to achieve the hermaphroditic mating of two housing halves. Each housing half includes a plurality of contact receptacles defined by parallel spaced apart contact guides. The contact guides are configured to positively position each terminal in both the longitudinal and lateral directions in the edge card socket. The longitudinally extending contact retaining wall is adjacent the top of the housing half and defines a portion of each contact receptacle. The electrical terminals include a solder tail at one end, a contact beam at the other end and a mounting portion therebetween. The mounting portion is heat staked into the housing half such that the extreme end of the contact beam is disposed intermediate the contact retaining wall and the outer wall of the housing half. Additionally, the terminals are provided with an anti-overstress configuration and are preloaded against the contact retaining wall to achieve good, reliable high pressure electrical contact with a circuit card mounted therein.

Although the invention has been described with respect to certain preferred embodiments, it is apparent that various changes can be made therein by those skilled in this art. For example, instead of mounting the connector housing on a master board and providing solder tail connections therewith, the edge card connector may be panel mounted. Thus, instead of solder tails, the terminals may be provided with other contact portions such as pin terminals or pin receiving female terminals, adapted to electrically engage terminals of a matable connector received in the panel. All such obvious modifications or changes may be made herein by those skilled in this art without departing from the scope of the invention as defined by the apended claims.

I claim:

1. A double-sided edge connector for connecting closely-spaced circuits on a double-sided printed circuit card to another circuit member, said edge connector including:

an integral dielectric housing including a pair of substantially identical housing halves secured together and defining an elongate card-receiving slot therebetween, each housing half having a generally rectangular open-sided configuration including a pair of opposed end walls, a top wall, an opposed bottom wall and an outer sidewall extending between and connecting the end walls and top and bottom walls, each housing half including a plurality of parallel spaced contact guides extending orthogonally from the top, bottom and outer side walls, defining a plurality of contact receptacles therebetween;

a plurality of elongate metallic strip terminals, each terminal having an intermediate mounting portion, an elongate resilient contact beam extending from the mounting portion to a free end with a contact surface defined between the mounting portion and the free end for electrically engaging a conductive region on an edge card and a second contact portion extending from the mounting portion for electrically engaging said another circuit member, each terminal disposed in a contact receptacle such that when said pair of housing halves are secured together said contact surfaces are disposed within the card-receiving slot; and means for securing said housing halves together;

the contact position improvement comprising:

each housing half further including a contact-retaining wall extending between said end walls disposed adjacent the top wall and spaced from and parallel to said outer side wall;

the free end of each contact beam engaging said contact-retaining wall with a pre-load directed away from said outer sidewall for positioning the contact surface of said contact beam at a location spaced from the outer sidewall;

first cooperating means in each contact receptacle and on the mounting portion of each terminal for controlling movement of the contact surface away from the top wall;

second cooperating means in each housing half and on the mounting portion of each terminal for controlling movement of the contact surface toward the top wall; and retention means for positively retaining each of said terminal mounting portions in each of said housing halves.

2. A double-sided edge connector as in claim 1, wherein said retention means comprises a continuous unitary bead in each housing half over each of said terminal mounting portions extending between the end walls adjacent the bottom wall.

3. A double-sided edge connector as in claim 1, wherein said terminal mounting portion is defined by a strip portion on said terminal having a reduced width with respect to the width of said contact beam portion and said first cooperating means includes a pair of opposed alignment ribs extending into said contact receptacle from the adjacent contact guides to define a gap therebetween having a width substantially equal to the reduced width of the terminal mounting portion.

4. A double-sided edge connector as in claim 1, wherein each contact guide includes a bottom edge disposed adjacent the bottom wall and said second cooperating means includes an opposed pair of alignment sholders defined in each terminal mounting portion adapted to engage the bottom edges of adjacent contact guides to limit movement of the terminal in the contact receptacle toward said top wall.

5. A double sided edge connector as in claim 1, wherein the contact beam portion of each terminal is provided with an anti-overstress bend toward said outer sidewall adjacent the terminal mounting portion.

6. A method for making an improved double sided edge connector, said method including the steps of:

molding a pair of substantially identical housing halves having a generally rectangular open sided configuration and including a plurality of parallel spaced contact guides defining contact receptacles therebetween;

stamping sheet metal stock to define a plurality of elongate metallic strip terminals having an intermediate mounting portion, a contact beam portion extending from said mounting portion and a second contact portion extending from said intermediate mounting portion extending from a carrier strip;

forming the contact beam portions to define a contact surface therealong;

loading the terminals on said carrier strip into the contact receptacles of each housing half; and securing said pair of housing halves together to define an elongate card receiving slot with the contact surfaces disposed in said slot; and removing said carrier strip;

the improvement comprising the steps of:

providing each housing half with a contact retaining wall extending across each of said contact receptacles;

loading said terminals in each housing half by engaging the free ends of the contact beam portions of the terminals under said contact retaining wall and thereafter urging each terminal mounting portion into its respective contact receptacle; and thereafter, staking the terminal mounting portions into each housing half to positively retain the terminals in each housing half prior to securing the housing halves together to form the connector.

* * * * *